US008821175B2

(12) United States Patent
Jiang et al.

(10) Patent No.: US 8,821,175 B2
(45) Date of Patent: Sep. 2, 2014

(54) USB CONNECTOR, USB HOUSING, AND WIRELESS MODEM

(75) Inventors: Yaming Jiang, Shenzhen (CN); Bin Zhang, Shenzhen (CN); Pengsheng Chen, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 592 days.

(21) Appl. No.: 13/181,239

(22) Filed: Jul. 12, 2011

(65) Prior Publication Data

US 2012/0008268 A1 Jan. 12, 2012

(30) Foreign Application Priority Data

Jul. 12, 2010 (CN) ..... 2010 1 0227602
Aug. 13, 2010 (CN) ..... 2010 1 0257477

(51) Int. Cl.

| | |
|---|---|
| ***H01R 13/15*** | (2006.01) |
| ***H01R 35/04*** | (2006.01) |
| ***H01Q 1/22*** | (2006.01) |
| ***H01Q 1/24*** | (2006.01) |
| *H01R 13/44* | (2006.01) |
| *H01R 107/00* | (2006.01) |

(52) U.S. Cl.

CPC ..... *H01Q 1/241* (2013.01); *H01R 35/04* (2013.01); *H01Q 1/2275* (2013.01); *H01R 13/44* (2013.01); *H01R 2107/00* (2013.01)

USPC ..... 439/261

(58) Field of Classification Search

USPC ..... 439/528, 261, 55, 95, 96, 108, 607.2, 439/607.31, 607.34; 361/679.4

See application file for complete search history.

(56) References Cited

U.S. PATENT DOCUMENTS

| | | | | |
|---|---|---|---|---|
| 7,066,753 | B1 | 6/2006 | Tseng | |
| 7,234,963 | B1 * | 6/2007 | Huang | 439/446 |
| 2004/0048494 | A1 * | 3/2004 | Yu | 439/11 |
| 2004/0082370 | A1 | 4/2004 | Gahl et al. | |
| 2007/0270022 | A1 | 11/2007 | Lin | |

(Continued)

FOREIGN PATENT DOCUMENTS

| | | | |
|---|---|---|---|
| CM | 1491156 | A | 4/2004 |
| CN | 201156604 | Y | 11/2008 |

(Continued)

OTHER PUBLICATIONS

International Searching Authority, International Application No. PCT/CN2011/077046, Dated: Sep. 22, 2011 14 pages.

(Continued)

*Primary Examiner* — Edwin A. Leon
(74) *Attorney, Agent, or Firm* — Slater & Matsil, L.L.P.

(57) ABSTRACT

A Universal Serial Bus (USB) connector, a USB housing, and a wireless modem are provided in the embodiments of the present invention. The USB connector includes a USB housing, a subcard, a cable, a metal terminal, and a rotating shaft assembly. The USB housing includes a bottom with a first fixing plate and a second fixing plate respectively disposed on two opposite sides. The second fixing plate is disposed with a second hole. The subcard, the first fixing plate, and the second fixing plate are disposed on a same end of the bottom. The metal terminal is disposed on a surface of the subcard. One end of the cable is connected to the metal terminal. The rotating shaft assembly penetrates the second hole.

30 Claims, 8 Drawing Sheets

(56) References Cited

U.S. PATENT DOCUMENTS

| | | | |
|---|---|---|---|
| 2009/0215284 | A1 | 8/2009 | Zhao et al. |
| 2010/0029330 | A1 | 2/2010 | Hertlein et al. |
| 2010/0039347 | A1 | 2/2010 | Chen |

FOREIGN PATENT DOCUMENTS

| | | | |
|---|---|---|---|
| CN | 201242759 | Y | 5/2009 |
| CN | 201298604 | Y | 8/2009 |
| CN | 101652040 | A | 2/2010 |
| CN | 201417877 | Y | 3/2010 |
| CN | 201417877 | Y | 3/2010 |
| CN | 101931133 | A | 12/2010 |
| CN | 201682164 | U | 12/2010 |
| CN | 201758176 | U | 3/2011 |
| EP | 2096724 | A1 | 9/2009 |
| JP | 2000269662 | A | 9/2000 |
| JP | 2005258974 | A | 9/2005 |
| JP | 3130455 | U | 3/2007 |
| JP | 2010-121742 | | 6/2010 |
| WO | 2009105953 | A1 | 3/2009 |
| WO | WO 2009/105953 | A1 | 9/2009 |

OTHER PUBLICATIONS

Extended European Search Report, European Application No. 11173445.5-1231, Applicant: Huawei Device Co., Ltd., Dated: Sep. 30, 2011, 7 pages.

International Searching Authority, International Application No. PCT/CN2011/077048, Dated: Oct. 20, 2011, 11 pages.

Chinese Office Action, Chinese Application No. 201010257477.X, Dated: Feb. 22, 2011, 16 pages.

Notice of Reason for Rejection received in Application No. 2011-153706 mailed Nov. 20, 2012, 6 pages.

Communication pursuant to Article 94(3) EPC received in Application No. 11173445.5-1801 mailed Mar. 24, 2014, 6 pages.

* cited by examiner

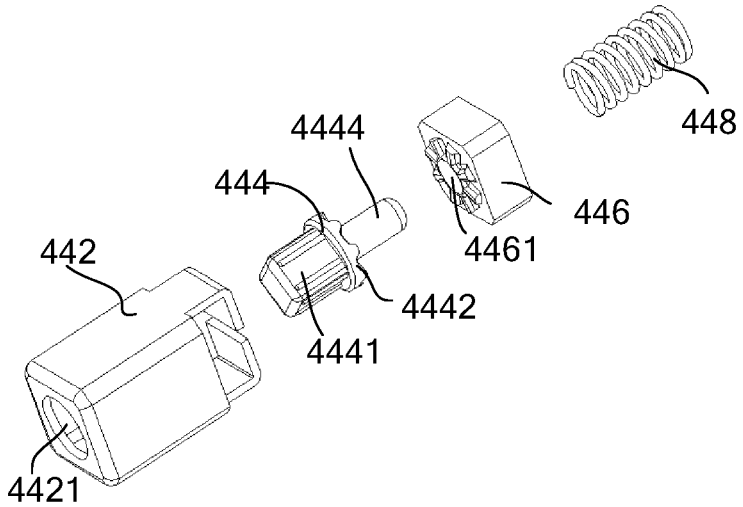
FIG. 3
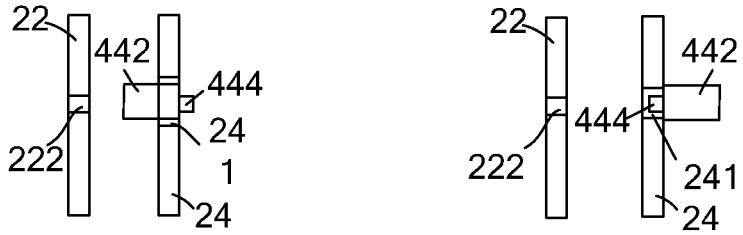
FIG. 4(a) FIG. 4(b)
FIG. 4

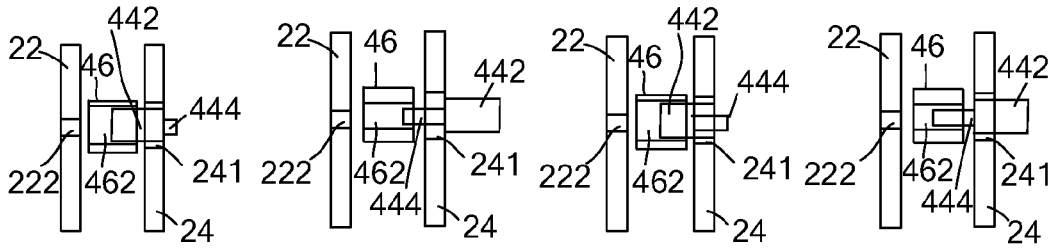
FIG. 5(a) FIG. 5(b) FIG. 5(c) FIG. 5(d)
FIG. 5
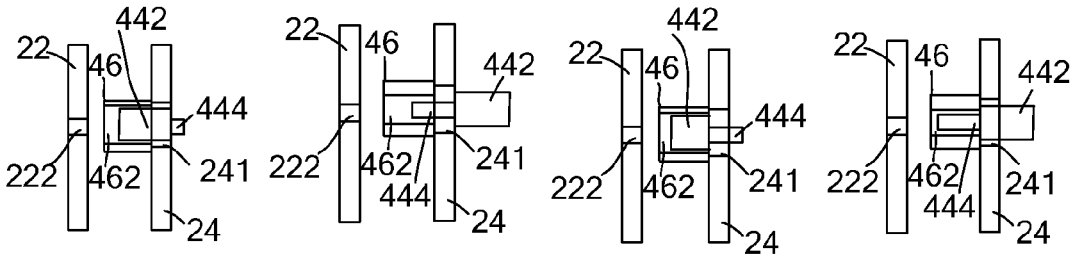
FIG. 6(a) FIG. 6(b) FIG. 6(c) FIG. 6(d)
FIG. 6

USB CONNECTOR, USB HOUSING, AND WIRELESS MODEM

This application claims priority to Chinese Patent Application No. 201010227602.2, filed on Jul. 12, 2010, and Chinese Patent Application No. 201010257477.X, filed on Aug. 13, 2010, both of which are hereby incorporated by reference in their entireties.

TECHNICAL FIELD

The present invention relates to the field of communications technology, and more particularly, to a USB connector, a USB housing, and a wireless modem.

BACKGROUND

As the mobile communications technologies develop rapidly, data services such as wireless network access become increasingly mature, and portable compact wireless network access terminals, such as wireless modem (including wireless network access card), gain more attention and become more popular.

A legacy wireless network access card can be connected to a computer through a USB connector to provide wireless network access for users.

During the implementation of the present invention, the inventor finds that common wireless network access card available on the market are generally not portable and fail to meet the requirements of modern people for compact and exquisite electronic products due to the limitations of USB connectors: The USB connectors are thick and require large space.

SUMMARY OF THE INVENTION

Embodiments of the present invention provide a USB connector, a USB housing, and a wireless modem, which is capable for reducing the thickness and footprint of the USB connector and therefore portable.

An embodiment of the invention provides a USB connector. The USB connector comprises includes a USB housing, a subcard, a cable, a metal terminal, and a rotating shaft assembly. The USB housing includes a bottom. A first fixing plate and a second fixing plate are respectively disposed on the two opposite sides of the bottom. A second hole is disposed on the second fixing plate. The subcard is disposed on the bottom, and the subcard, the first fixing plate, and the second fixing plate are disposed on a same side of the bottom. The metal terminal is partially or fully disposed on the surface of the subcard. One end of the cable is connected to the metal terminal. The rotating shaft assembly penetrates the second hole.

An embodiment of the invention provides a USB housing. The USB housing includes a bottom. A first fixing plate and a second fixing plate are respectively disposed on the two opposite sides of the bottom. The first fixing plate and the second fixing plate are disposed on a same side of the bottom. A second hole is disposed on the second fixing plate. The second hole is used for the penetration of a rotating shaft assembly.

An embodiment of the invention provides a wireless modem. The wireless modem includes a USB connector and a main body. The USB connector includes a USB housing, a subcard, a cable, a metal terminal, and a rotating shaft assembly. The USB housing includes a bottom. A first fixing plate and a second fixing plate are respectively disposed on the two opposite sides of the bottom. A second hole is disposed on the second fixing plate. The subcard is disposed on the bottom. The subcard, the first fixing plate, and the second fixing plate are disposed on a same side of the bottom. The metal terminal is partially or fully disposed on the surface of the subcard. One end of the cable is connected to the metal terminal, and the other end of the cable is connected to a welding pad of a PCB on the main body. The rotating shaft assembly penetrates the second hole. The USB connector connects to the main body through the rotating shaft assembly.

An embodiment of the invention provides a USB connector. The USB connector includes a USB housing, a subcard, a cable, a metal terminal, a rotating shaft assembly, and a rotating shaft support. The USB housing includes a bottom. A first fixing plate and a second fixing plate are respectively disposed on the two opposite sides of the bottom. A first hole is disposed on the first fixing plate, and a second hole is disposed on the second fixing plate. The subcard is disposed on the bottom. The subcard, the first fixing plate, and the second fixing plate are on a same side of the bottom. The metal terminal is partially or fully disposed on the surface of the subcard. One end of the cable is connected to the metal terminal, and the other end of the cable penetrates the first hole. A third hole is disposed on one side of the rotating shaft support. The rotating shaft support is disposed between the first fixing plate and the second fixing plate, and fixed onto one side of the second fixing plate. The second hole communicates with the third hole. The rotating shaft assembly includes a rotating shaft and a rotating shaft sleeve. The rotating shaft is disposed into the rotating shaft sleeve and can rotate relative to the rotating shaft sleeve. The rotating shaft sleeve penetrates the third hole through the second hole and is fixed to the third hole. The rotating shaft protrudes beyond the second hole.

The foregoing description shows that the bottom of the USB housing can be configured to fix the subcard; the cable penetrates the first hole; the rotating shaft assembly penetrates the second hole. This reduces the thickness and footprint of the USB connector and therefore makes the USB connector portable.

BRIEF DESCRIPTION OF THE DRAWINGS

To describe the technical solutions in the embodiments of the present invention more clearly, the following outlines the accompanying drawings for illustrating such embodiments. Apparently, the described drawings are merely some drawings of the present invention. Based on the drawings of the present invention, those skilled in the art can obtain other drawings without making creative efforts.

FIG. 3 is an exploded diagram of a rotating shaft assembly according to an embodiment of the present invention;

FIG. 4 is a schematic diagram of a rotating shaft assembly penetrating a second hole according to an embodiment of the present invention;

FIG. 5 is a schematic diagram of a USB according to an embodiment of the present invention. The USB connector includes a rotating shaft support that is disposed between a first fixing plate and a second fixing plate, a second hole is opposite to a third hole, and the rotating shaft assembly penetrates the second hole;

FIG. 6 is a schematic diagram of a USB connector according to an embodiment of the present invention, in which the USB connector includes a rotating shaft support that is fixed onto one side of a second fixing plate, a second hole communicates with a third hole, and the rotating shaft support penetrates the second hole;

DETAILED DESCRIPTION OF ILLUSTRATIVE EMBODIMENTS

The technical solutions in the embodiments of the present invention are described below clearly and completely with reference to the accompanying drawings in the embodiments of the present invention. Apparently, the described embodiments are merely some embodiments of the present invention, rather than all of the embodiments. Based on the embodiments of the present invention, those skilled in the art can obtain other embodiments without making creative efforts, which all shall fall within the protection scope of the present invention.

Embodiment 1

Figure 1:
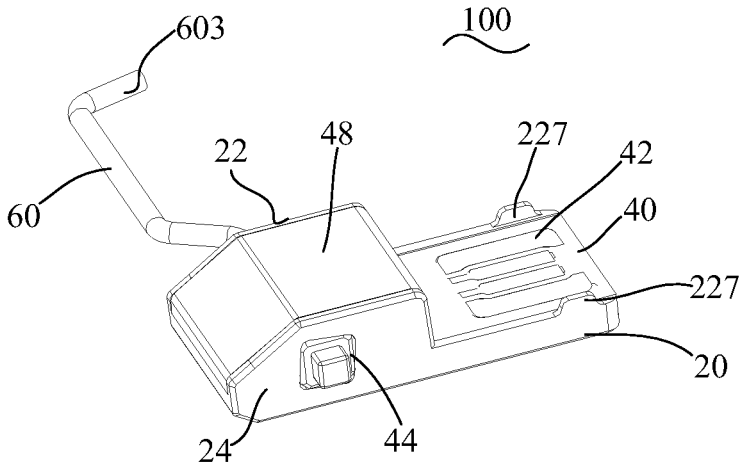
FIG. 1 is a three-dimensional schematic structural diagram of a USB connector according to an embodiment of the present invention.
Figure 2:
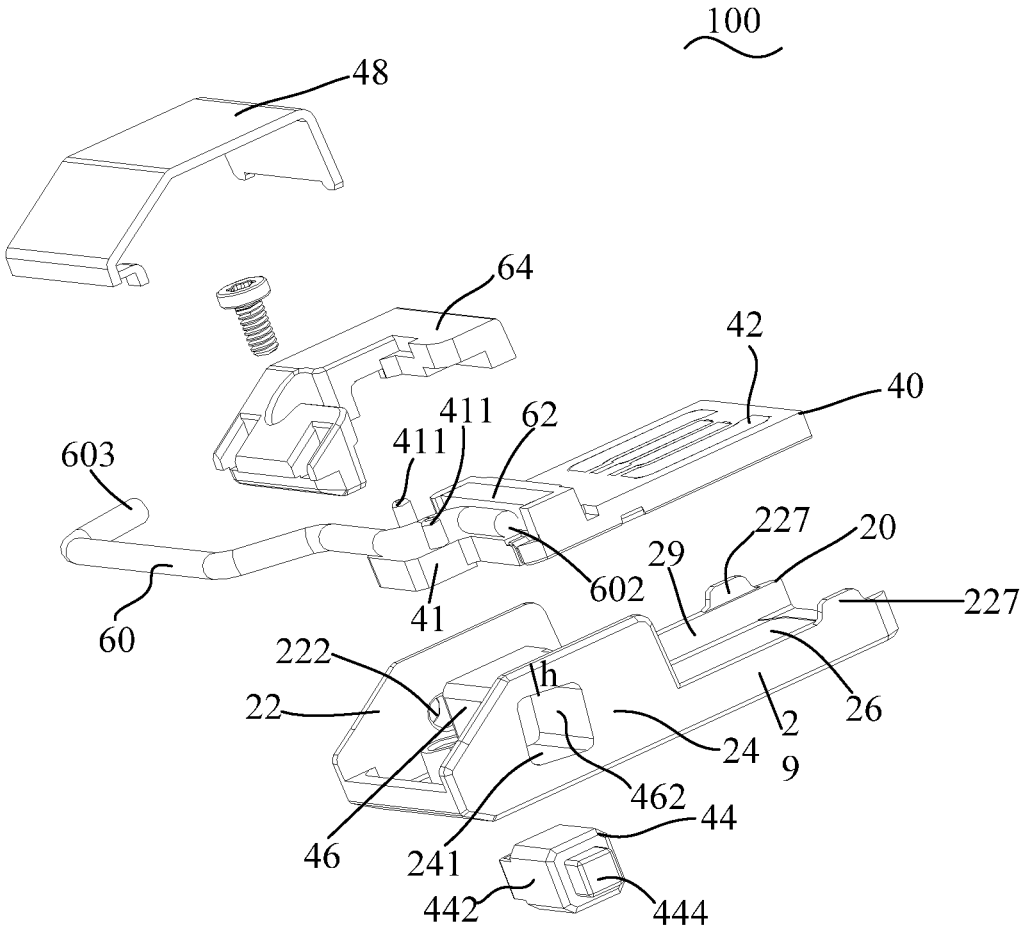
FIG. 2 is an exploded diagram of a USB connector according to an embodiment of the present invention.

See FIG. 1 and FIG. 2. FIG. 1 is a three-dimensional schematic structural diagram of a USB connector according to this embodiment of the present invention. FIG. 2 is an exploded diagram of a USB connector according to this embodiment of the present invention.

A USB connector 100 includes a USB housing 20, a subcard 40, a cable 60, a metal terminal 42, and a rotating shaft assembly 44. The USB housing 20 includes a bottom 26. A first fixing plate 22 and a second fixing plate 24 are respectively disposed on the two opposite sides of the bottom 26. A second hole 241 is disposed on the second fixing plate 24. The subcard 40 is disposed on the bottom 26. The subcard 40, the first fixing plate 22, and the second fixing plate 24 are on a same side of the bottom 26. The metal terminal 42 is partially or fully disposed on the surface of the subcard 40. One end 602 of the cable 60 is connected to the metal terminal 42. The rotating shaft assembly penetrates the second hole 241.

The foregoing description shows that the subcard 40 is disposed on the bottom 26, and the metal terminal 42 is partially or fully disposed on the surface of the subcard 40. This reduces the thickness and occupied space of the USB connector. As a result, the USB connector is portable and meets the requirements of modern people for compact electronic products.

A first hole 222 is disposed on the first fixing plate 22. The other end 603 of the cable penetrates the first hole 222.

The height of the second fixing plate 24 depends on the height of the second hole 241, and the height of the second hole 241 depends on the height of the rotating shaft assembly 44. Therefore, the height of the second fixing plate 24 depends on the height of the rotating shaft assembly 44. When the height of the rotating shaft assembly 44 is reduced, the height of the second fixing plate 24 can be reduced, and therefore, the thickness of the USB connector 100 can be significantly reduced (because the first hole 222 on the first fixing plate 22 is used for the penetration of the cable 60, the height of the first fixing plate 22 can be very small). Furthermore, when the USB housing 20 is metal, the height h can be reduced (as shown in FIG. 2), and the height of the second fixing plate 24 can be reduced. In this way, the thickness of the USB connector 100 can be reduced while its strength is ensured. As a result, the USB connector 100 can be very thin.

The first fixing plate 22 may be opposite to the second fixing plate 24. The size of the first fixing plate 22 is the same as the size of the second fixing plate 24; that is, they have the same outline.

The metal terminal 42 is partially or fully disposed on the subcard 40, including:

the part of the metal terminal 42 that connects to a USB interface is disposed on the surface of the subcard 40; or the metal terminal 42 is fully disposed on the subcard 40.

See FIG. 3, which is an exploded diagram of a rotating shaft assembly according to this embodiment of the present invention. The rotating shaft assembly 44 includes a rotating shaft sleeve 442 and a rotating shaft 444. The rotating shaft 444 is partially disposed into the rotating shaft sleeve 442. The rotating shaft 444 can rotate relative to the rotating shaft sleeve 442.

See FIG. 4, which is a schematic diagram of the rotating shaft assembly 44 penetrating the second hole 241. The rotating shaft assembly penetrating the second hole 241 specifically is:

The rotating shaft sleeve 442 penetrates and is fixed to the second hole 241 (see FIG. 4(*a*)); or the rotating shaft 444 penetrates and is fixed to the second hole 241 (see FIG. 4(*b*)).

See FIG. 2 again. The USB connector 100 further includes a rotating shaft support 46. The rotating shaft support 46 is disposed between a first fixing plate 22 and a second fixing plate 24. A third hole 462 is disposed on one side of the rotating shaft support 46. Furthermore, the rotating shaft support 46 can be fixed onto the bottom 26 of the USB housing. The second hole 241 is opposite to the third hole 462. The width of the rotating shaft support 46 may be smaller than the distance between the first fixing plate 22 and the second fixing plate 24; or the rotating shaft support 46 may be fixed onto one side of the second fixing plate 24, and the second hole 241 communicates with the third hole 462.

See FIG. 5. The USB connector 100 includes a rotating shaft support 46. The rotating shaft support 46 is disposed between the first fixing plate 22 and the second fixing plate 24. The third hole 462 is disposed on one side of the rotating shaft support 46. The second hole 241 is opposite to the third hole 462. The rotating shaft assembly 44 penetrates the second hole 241. Specifically, the rotating shaft assembly 44 penetrating the second hole 241 includes:

the rotating shaft sleeve 442 penetrates the second hole 241 and also the third hole 462, and is fixed to the third hole 462 (as shown in FIG. 5(*a*)); or, the rotating shaft 444 penetrates the second hole 241 and the third hole 462, and is fixed to the third hole 462 (as shown in FIG. 5(*b*)); or, the rotating shaft 444 penetrates and protrudes beyond the second hole 241; the rotating shaft sleeve 442 penetrates and is fixed to the third hole 462 (as shown in FIG. 5(*c*)); or, the rotating shaft sleeve 442 penetrates and protrudes beyond the second hole 241; the rotating shaft 444 penetrates and is fixed to the third hole 462 (as shown in FIG. 5(*d*)).

See FIG. 6. The USB connector 100 further includes the rotating shaft support 46. The rotating shaft support is disposed between the first fixing plate 22 and the second fixing plate 24. The third hole 462 is disposed on one side of the rotating shaft support 46. The rotating shaft support 46 is fixed onto one side of the second fixing plate 24. The second hole 241 communicates with the third hole 462. The rotating shaft assembly 44 penetrates the second hole 241. The rotating shaft assembly 44 penetrates the second hole 241, including:

the rotating shaft sleeve 442 penetrates the second hole 241 and the third hole 462, and is fixed to the third hole 462 (as shown in FIG. 6(*a*)); or;

the rotating shaft 444 penetrates the second hole 241 and the third hole 462 and is fixed to the third hole 462 (as shown in FIG. 6(*b*)); or, the rotating shaft 444 penetrates and protrudes the second hole 241; the rotating shaft sleeve 442 penetrates and is fixed to the third hole 462 (as shown in FIG. 6(*c*)); or, the rotating shaft sleeve 442 penetrates and protrudes the second hole 241; the rotating shaft 444 penetrates and is fixed to the third hole 462 (as shown in FIG. 6(*d*)).

It should be noted that if the rotating shaft 444 or rotating shaft sleeve 442 of the rotating shaft assembly 44 is partially disposed in the second hole 241, it can be deemed that the rotating shaft assembly 44 penetrates the second hole 241; if the rotating shaft 444 or rotating shaft sleeve 442 of the rotating shaft assembly 44 is fully disposed in the second hole 241, it can also be deemed that the rotating shaft 44 penetrates the second hole 241.

For example, the rotating shaft sleeve 442 in FIG. 4(*a*) is partially disposed in the second hole 241, or the rotating shaft 444 in FIG. 4(*b*) is disposed in the second hole 241. For the two modes in FIG. 4, it can be deemed that the rotating shaft assembly 44 penetrates the second hole 241;

Similarly, the rotating shaft sleeve 442 in FIG. 5(*a*) is partially disposed in the second hole 241, or the rotating shaft 444 in FIG. 5(*b*) is partially disposed in the second hole 241, or the rotating shaft 444 in FIG. 5(*c*) is partially disposed in the second hole 241, or the rotating shaft sleeve 442 in FIG. 5(*d*) is partially disposed in the second hole 241. For the four modes in FIG. 5, it can be deemed that the rotating shaft assembly 44 penetrates the second hole 241;

Similarly, the rotating shaft sleeve 442 in FIG. 6(*a*) is partially disposed in the second hole 241, or the rotating shaft 444 in FIG. 6(*b*) is partially disposed in the second hole 241, or the rotating shaft 444 in FIG. 6(*c*) is partially disposed in the second hole 241, or the rotating shaft sleeve 442 in FIG. 6(*d*) is partially disposed in the second hole 241. For the four modes in FIG. 6, it can be deemed that the rotating shaft assembly 44 penetrates the second hole 241. Furthermore, the foregoing description shows that the rotating shaft 444 is fixed to the third hole 462, or the rotating shaft sleeve 442 is fixed to the third hole 462. The two modes can strengthen the coordination between the rotating shaft 444 or rotating shaft sleeve 442 and the second fixing plate 24 to avoid damaging the fixing plate 24 due to too much force.

It should be noted that the third hole 462 of the rotating shaft support 46 only needs to be of a depth allowing for the penetration and fixing of the rotating shaft sleeve 442 or the rotating shaft 444. Of course, the third hole 462 can run through the rotating shaft support 46. The depth of the third hole 462 is not limited in the embodiments of the present invention.

See FIG. 3 again. The rotating shaft assembly 44 further includes a fixing gear plate 446 and an elastic part 448. The rotating shaft 444 includes a rotor 4441, a rotating gear plate 4442, and a tail end 4444. A hole 4421 is disposed on one side of the rotating shaft sleeve 442. Another hole 4461 is disposed on the rotating fixing gear plate 446. The rotating shaft 444, the fixing gear plate 446, and the elastic part 448 are disposed into the rotating shaft sleeve 442. The tail end 4444 penetrates the hole 4461 and the elastic part 448. The rotating gear plate 4442 is engaged with the fixing gear plate 446. The rotor 4441 penetrates the hole 4421. The elastic part 448 may be a spring.

Therefore, when the rotating shaft 444 rotates relative to the rotating shaft sleeve 442, the rotating gear plate 4442 can rotate relative to the fixing gear plate 446. After the rotation, the rotating gear plate 4442 is engaged with the fixing gear plate, which implements the positioning function well. For example, the rotating shaft 444 rotates relative to the rotating shaft sleeve 442; the rotating shaft can stop rotating after rotating by every 45 or 90 degrees.

It should be understood that the rotating gear plate 4442 and the fixing gear plate 446 may have different numbers of gear teeth. When the rotating gear plate 4442 rotates relative to the fixing gear plate 446, it can rotate by different angles. When there are a large number of gear teeth, the rotating gear plate 4442 can rotate by a small angle; when there are a small number of gear teeth, the rotating gear plate 4442 can rotate by a large angle.

See FIG. 3 again. The cross sections of the rotating shaft sleeve 442 and the rotating shaft 444 may be square. It is to be understood that the cross sections of the rotating shaft sleeve 442 and the rotating shaft 444 may also be triangular, pentagonal, and hexagonal. Of course, the cross sections of the rotating shaft sleeve 442 and the rotating shaft 444 may also be circular or oval. After external force is applied, the rotating shaft 444 can rotate relative to the rotating shaft sleeve 442. The cross sections of the rotating shaft sleeve 442 and the rotating shaft 444 are not limited in the embodiments of the present invention.

The subcard 40 is disposed on the bottom 26. Specifically, the subcard 40 may be stuck to the bottom 26 of the USB housing 20 by using adhesives (for example, double-sided tape or glue). Of course, the subcard 40 may also be fixed onto the bottom 26 by using screws. The embodiments of the present invention is not limited to such ways.

See FIG. 2 again. Furthermore, convex lines 29 are respectively disposed on the bottom 26 of the USB housing 20 along two sides of the subcard 40 to better fix the subcard 40. The first fixing plate 22, the second fixing plate 24, the subcard 40, and the convex lines 29 are on a same end of the bottom 26.

The distance between the convex lines 29 may be the width of the subcard 40. That is, the space between the convex lines can accommodate the subcard 40. The thickness of the subcard 40 may be the same as the height of the convex lines 29. Therefore, when the USB connector is connected to the USB interface, the subcard 40 will not be damaged due to collisions.

It should be understood that the bottom 26, the first fixing plate 22, and the second fixing plate 24 may be integrated. Furthermore, the rotating shaft support 46, the bottom 26, the first fixing plate 22, and the second fixing plate 24 may also be integrated; the convex lines 29, the bottom 26, the rotating shaft support 46, the first fixing plate 22, and the second fixing plate, may also be integrated. Of course, the rotating shaft support 46 can also be disposed separately from the bottom 26, the first fixing plate 22, and the second fixing plate 24; the convex lines 29 can also be disposed separately from the bottom 26, the first fixing plate 22, and the second fixing plate 24. No relevant limitation is defined in the embodiments of the present invention.

See FIG. 1 again. The USB connector 100 further includes a cover 48. The cover 48, the first fixing plate 22, and the second fixing plate 24 form an enclosed space.

Specifically, the cover 48 may be stuck to the first fixing plate 22 and the second fixing plate 24 by using adhesives (for example, double-sided tape or glue). Of course, a bump may be disposed on the first fixing plate 22, and a recess may be disposed on the cover 48. The recess can be snapped to the bump (omitted in the figure) so that the cover 48 stays between the first fixing plate 22 and the second fixing plate 24. Therefore, the cover 48, the first fixing plate 22, and the second fixing plate form an enclosed space.

See FIG. 2 again. The USB connector 100 further includes a fixing bracket 62. The fixing bracket 62 is fixed at the joint between the metal terminal 42 and one end of the cable 60 to enhance the reliability.

The USB connector 100 further includes a fixing block 64. The fixing block 64 is fixed in the space formed by the first fixing plate 22, the second fixing plate 24, and the rotating shaft support 46. The shape of the fixing block 64 may match the space formed by the first fixing plate 22, the second fixing plate 24, and the rotating shaft support 46. Specifically, the fixing block 64 may be U-shaped. The fixing block 64 may be fixed by using screws. Of course, the fixing block may be inserted in the space formed by the first fixing plate 22, the second fixing plate 24, and the rotating shaft support 46.

See FIG. 2 again. The subcard 40 extends toward the space formed by the rotating shaft support 46 and the first fixing plate 22 along the plane where the subcard 40 is disposed to form an extension 41. Two bumps 411 are disposed on the extension 41. The other end 603 of the cable 60 passes through the space formed by the two bumps 411 and penetrates the first hole 222. The other end of the cable 60 can be welded onto a PCB. Specifically, the other end of the cable 60 can be welded on the welding pad of the PCB.

For the preceding embodiments, the subcard 40 may be a PCB subcard, and the metal terminal 42 can be partially or fully disposed on the surface of the PCB subcard. Of course, the subcard 40 may also be plastic; in this case, the metal terminal 42 can be partially or fully disposed on the surface of the plastic subcard by means of insert molding.

It should be noted that the USB housing 20 may be metal; the convex lines 29, the first fixing plate 22, and the second fixing plate 24 may be metal; the rotating shaft support 46 may also be metal. Of course, the USB housing 20 may also be plastic. No relevant limitation is defined in the embodiments of the present invention.

Furthermore, for the preceding embodiments, the convex lines 29 are respectively disposed on the bottom of the USB housing 20 along two sides of the subcard 40. A misplug prevention structure 227 is formed on one end of each convex line 29. The misplug prevention structure 227 can prevent the USB connector 100 from being reversely connected to the USB interface.

The procedure for assembling the USB connector 100 is described below with reference to FIG. 2. The USB housing 20 (comprising the bottom 26, the first fixing plate 22, and the second fixing plate 24) and the rotating shaft support 46 are integrated; the subcard 40 includes an extension 41; the metal terminal 42 is partially disposed on the subcard 40; two bumps 411 are disposed on the extension 41.

First, fix the subcard 40 with the extension 41 onto the bottom 26 of the USB housing 20 (the extension 41 is disposed in the space between the rotating shaft support 46 and the first fixing plate 22);

then, connect one end of the cable 60 to the metal terminal 42 (specifically, weld four cores of the cable 60 to the four metal terminals 42 respectively); put the other end 603 of the cable through the space formed by the two bumps 411 and then through the first hole 222 disposed on the first fixing plate 22;

fix the fixing bracket 62 to the joint between the metal terminal 42 and one end 602 of the cable 60; fix the fixing block 64 in the space formed by the first fixing plate, the second fixing plate, and the rotating shaft support 46; then tighten up the screws;

last, form an enclosed space with the cover 48, the first fixing plate 22, and the second fixing plate 24; specifically, fix the cover 48 to surfaces of the rotating shaft support 46 and the fixing block 64 and between the first fixing plate 22 and the second fixing plate 24, so that the cover 48, the first fixing plate 22, and the second fixing plate 24 form an enclosed space.

The USB connector 100 is assembled. Of course, though only one type of procedure for assembling the USB connector 100 is described in the embodiments of the present invention, the procedure for assembling the USB connector 100 is not limited to the preceding procedure.

It should be noted that the cross section of the part of the USB housing for disposing the subcard 40 is U shaped (that is, the cross section of the part of the USB housing formed by the bottom 26 and the convex lines 29 is U shaped). The USB connector 100 may be a USB interface. The USB interface may be a non-standard USB interface; that is, the USB interface may be a half-socket USB interface (for example, the USB connector shown in FIG. 1).

FIG. 2 shows a USB connector provided in this embodiment of the present invention. The USB connector 100 includes a USB housing 20, a subcard 40, a cable 60, a metal terminal 42, a rotating shaft assembly 44, and a rotating shaft support 46. The USB housing 20 includes a bottom 26. A first fixing plate 22 and a second fixing plate 24 are respectively disposed on the two opposite sides of the bottom 26. A first hole 222 is disposed on the first fixing plate 22, and a second hole 241 is disposed on the second fixing plate 24. The subcard 40 is disposed on the bottom 26. The subcard 40, the first fixing plate 22, and the second fixing plate 24 are on a same end of the bottom 26. The metal terminal 42 is partially or fully disposed on the surface of the subcard 40. One end 602 is connected to the metal terminal 42. The other end 603 of the cable 60 penetrates the first hole 222. A third hole 462 is disposed on one side of the rotating shaft support 46. The rotating shaft support 46 is disposed between the first fixing plate 22 and the second fixing plate 24. The rotating shaft support 46 is fixed on one side of the second fixing plate 24. The second hole 241 communicates with the third hole 462. The rotating shaft assembly 44 includes a rotating shaft 444 and a rotating shaft sleeve 442. The rotating shaft 444 is disposed into and can rotate relative to the rotating shaft sleeve 442. The rotating shaft sleeve 442 penetrates the third hole 462 through the second hole 241. The rotating shaft 442 is fixed to the third hole 462. The rotating shaft 444 penetrates beyond the second hole 241.

The foregoing description shows that the subcard 40 is disposed on the bottom 26, and the metal terminal 42 is partially or fully disposed on the surface of the subcard 40. This reduces the thickness and occupied space of the USB connector. As a result, the USB connector is portable and meets the requirements of modern people for compact electronic products.

It should be noted that the cable 60 whose one end connected to the metal terminal 42 may be a flexible printed cable (FPC) or a common cable. No relevant limitation is defined in the embodiments of the present invention.

Embodiment 2

Figure 7:
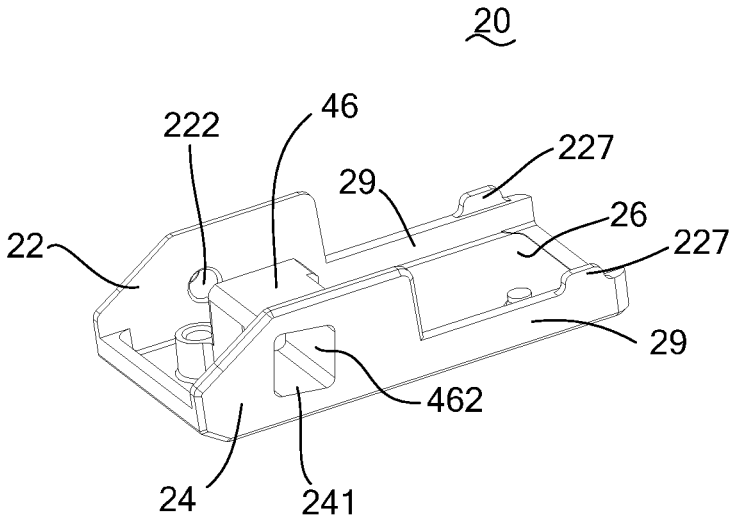
FIG. 7 is a three-dimensional schematic structural diagram of a USB housing according to an embodiment of the present invention.

FIG. 7 is a schematic structural diagram of a USB housing according to this embodiment of the present invention. The USB housing 20 includes the bottom 26. The first fixing plate 22 and the second fixing plate 24 are respectively disposed on the two opposite sides of the bottom 26. The first fixing plate 22 and the second fixing plate 24 are on a same end of the bottom 26. The second hole 241 is disposed on the second fixing plate 24. The second hole 241 is used for the penetration of the rotating shaft assembly 44 (see FIG. 2).

The foregoing description shows that the bottom 26 of the USB housing 20 can be configured to fix the subcard 40; the cable 60 penetrates the first hole 222; the rotating shaft assembly 44 penetrates the second hole 241. This reduces the thickness and occupied space of the USB connector and makes the USB connector portable.

The first hole 222 is disposed on the first fixing plate 22. The first hole 222 is used for the penetration of the cable 60 (as shown in FIG. 2).

The height of the second fixing plate 24 depends on the height of the second hole 241, and the height of the second hole 241 depends on the height of the rotating shaft assembly 44. Therefore, the height of the second fixing plate 24 depends on the height of the rotating shaft assembly 44. When the height of the rotating shaft assembly 44 is reduced, the height of the second fixing plate 24 can be reduced, and therefore the thickness of the USB connector 100 can be significantly reduced (because the first hole 222 on the first fixing plate 22 is used for the penetration of the cable 60, the height of the first fixing plate 22 can be small). Furthermore, when the USB housing is metal, the height h can be reduced (as shown in FIG. 2), and the height of the second fixing plate 24 can be reduced. In this way, the thickness of the USB connector 100 can be reduced while its strength is ensured. As a result, the USB connector 100 can be very thin.

The USB housing 20 may be metal.

Furthermore, convex lines 29 are respectively disposed along two opposite sides of the bottom 26. The first fixing plate 22, the second fixing plate 24, and the convex line are on a same side of the bottom 26. Additionally, the first fixing plate 22 and one convex line 29 are on one side of the bottom, and the second fixing plate 22 and the other convex line 29 are on the other side of the bottom.

The misplug prevention structure 227 is disposed on one end of each convex line 29. The misplug prevention structure 227 can prevent the USB connector from being reversely connected.

See FIG. 7 again. The USB housing 20 further includes the rotating shaft support 46. The rotating shaft support 46 is disposed between the first fixing plate 22 and the second fixing plate 24. The third hole 462 is disposed on one side of the rotating shaft support 46. Furthermore, the rotating shaft support 46 can be fixed onto the bottom 26 of the USB housing. The third hole 462 is opposite to the second hole 241. The width of the rotating shaft support 46 may be smaller than the distance between the first fixing plate 22 and the second fixing plate 24; or the rotating shaft support 46 can be fixed onto one side of the second fixing plate 24, and the second hole 241 communicates with the third hole 462.

It should be noted that the second hole 241 in Embodiment 2 is used for the penetration of the rotating shaft assembly 44. For details, see the descriptions of FIG. 4, FIG. 5, or FIG. 6 in Embodiment 1, and the details are not provided herein again.

It should be noted that the cable in this embodiment may be an FPC or a common cable. No relevant limitation is defined in the embodiments of the present invention.

Embodiment 3

Figure 8:
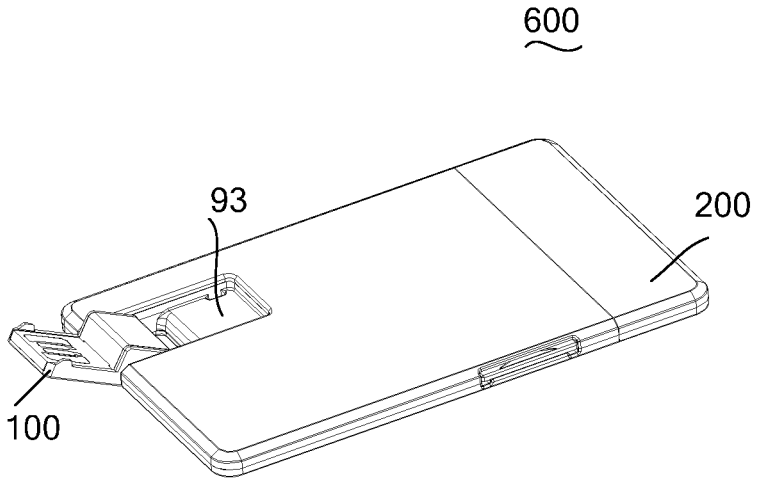
FIG. 8 is a schematic structural diagram of a wireless modem according to an embodiment of the present invention.
Figure 9:
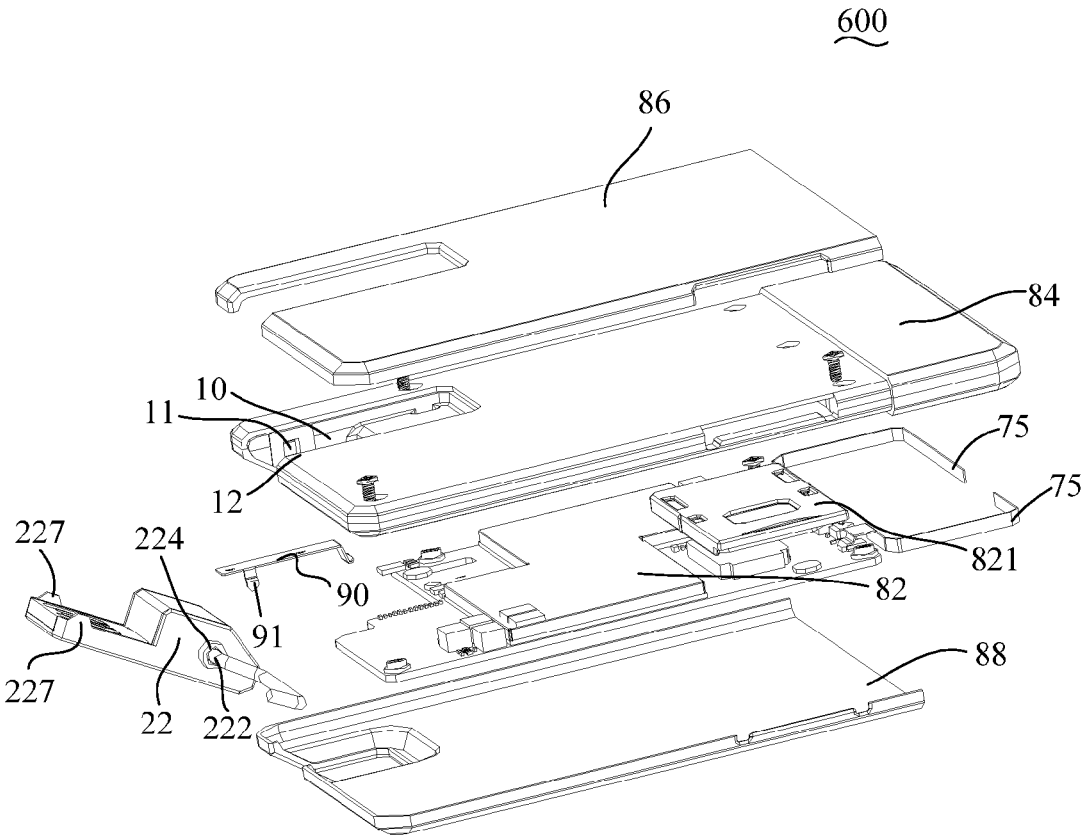
FIG. 9 is an exploded diagram of a wireless modem according to an embodiment of the present invention.

See FIG. 8, FIG. 9, and FIG. 2. FIG. 8 is a schematic structural diagram of a wireless modem according to this embodiment of the present invention. FIG. 9 is an exploded diagram of a wireless modem according to this embodiment of the present invention.

The wireless modem 600 includes a USB connector 100 and a main body 200. The USB connector 100 includes a USB housing 20, a subcard 40, a cable 60, a metal terminal 42, and rotating shaft assembly 44. The USB housing 20 includes a bottom 26. A first fixing plate 22 and a second fixing plate 26 are respectively disposed on the two opposite sides of the bottom 26. A second hole 241 is disposed on the second fixing plate 24. The subcard 40 is disposed on the bottom 26. The subcard 40, the first fixing plate 22, and the second fixing plate 24 are on a same side of the bottom 26. The metal terminal 42 is partially or fully disposed on the surface of the subcard 40. One end 602 of the cable 60 is connected to the metal terminal 42, and the other end 603 of the cable 60 is connected to the PCB 82 of the main body 200. The rotating shaft assembly 44 penetrates the second hole 241. The USB connector 100 connects to the main body through the rotating shaft assembly 44.

The foregoing description shows that the subcard 40 is disposed on the bottom 26 of the USB housing 20; the metal terminal 42 is partially or fully disposed on the surface of the subcard 40. This reduces the thickness and occupied space of the USB connector. As a result, the USB connector is portable and meets the requirements of modern people for compact electronic products.

The other end 603 of the cable is connected to the PCB 82 of the main body 200 can be deemed that the other end 603 of the cable is connected to the welding pad of the PCB 82 of the main body 200.

Furthermore, a first hole 222 is disposed on the first fixing plate 22. The other end 603 of the cable being connected to the PCB 82 of the main body 200 specifically is: The other end 603 of the cable penetrates the first hole 222 and then is connected to the PCB 82 of the main body 200.

For details about the USB connector 100, see Embodiment 1. The USB connector 100 is not described in detail in this embodiment of the wireless modem 600.

For details about the USB housing 20, see the related part of Embodiment 1 and Embodiment 2. The USB housing 20 is not described in detail in this embodiment of the wireless modem 600.

See FIG. 8 and FIG. 2. The axle center of the rotating shaft 444 is parallel to the plane where the subcard 40 is disposed and is vertical to the extension direction of the metal terminal. That is, the USB connector 100 can rotate forward around the axle center of the rotating shaft 444 (as shown in FIG. 8).

See FIG. 9 for an exploded diagram of a wireless modem provided in this embodiment of the present invention. Components are disposed on one side of the PCB 82.

A SIM socket 821 is disposed on the PCB 82. A SIM card can be inserted in the SIM socket.

See FIG. 9 again. The main body 200 includes a surface shell 84, the PCB 82, an upper shell 86, and a lower shell 88. The surface shell 84 is disposed on one side of the PCB 82; the upper shell 86 is disposed on one side of the surface shell 84; the lower shell 88 is disposed on the other side of the PCB 82. The upper shell 86 and the lower shell 88 are fixed. The surface shell 84 and the PCB 82 are disposed in the space formed by the upper shell 86 and the lower shell 88. The upper shell 86 and the lower shell 88 may be welded by using ultrasonic waves.

See FIG. 9 again. A notch 10 is disposed on one side of the surface shell 84. A fourth hole 11 and a fifth hole 12 are respectively disposed on the two sides of the notch 10. The fourth hole 11 may fix the rotating shaft 444 or the rotating shaft sleeve 442. A notch is also disposed on the corresponding sides of the upper shell 86 and the lower shell 88. In this way, the notches of the upper shell 86, the lower shell 88, and the surface shell 84 can hold the USB connector 100 so that the USB connector 100 can rotate within the notches.

The USB connector 100 is connected to the main body 200 through the rotating shaft assembly 44, specifically:

the rotating shaft 444 is fixed to the fourth hole 11, and the rotating shaft sleeve 442 penetrates and is fixed to the second hole 241 (as shown in FIG. 4(*a*)); or the rotating shaft 444 is fixed to the fourth hole 11, and the rotating shaft sleeve 442 penetrates the second hole 241 and the third hole 462 and is fixed to the third hole 462 (as shown in FIG. 5(*a*) and FIG. 6(*a*)); or the rotating shaft sleeve 442 is fixed to the fourth hole 11, and the rotating shaft 444 penetrates and is fixed to the second hole 241 (as shown in FIG. 4(*b*)); or the rotating shaft sleeve 442 is fixed to the fourth hole 11, and the rotating shaft 444 penetrates the second hole 241 and the third hole 462 and is fixed to the third hole 462 (as shown in FIG. 5(*b*) and FIG. 6(*b*)); or the rotating shaft 444 penetrates and protrudes beyond the second hole 241, the protruding part of the rotating shaft 444 outside the second hole 241 is fixed to the fourth hole 11, and the rotating shaft sleeve 442 penetrates and is fixed to the third hole 462 (as shown in FIG. 5(*c*) and FIG. 6(*c*)); or the rotating shaft sleeve 442 penetrates and protrudes beyond the second hole 241, the protruding part of the rotating shaft sleeve 442 outside the second hole 241 is fixed to the fourth hole 11, and the rotating shaft 44 penetrates and is fixed to the third hole 462 (as shown in FIG. 5(*d*) and FIG. 6(*d*)).

In the preceding way, the USB connector 100 can connect to the main body 200 through the rotating shaft assembly 44.

Furthermore, a circular shaft 224 is disposed on one side of the first fixing plate 22 around the first hole 222. The circular shaft 224 is disposed in the fifth hole 12.

The following takes the rotating shaft 444 fixed to the fourth hole 11 as an example. See FIG. 2. The cross sections of the rotating shaft 444 and the rotating shaft sleeve 442 may be square. Accordingly, the cross section of the fourth hole 11 on one side of the notch 10 may also be square, as shown in FIG. 6. In this way, the rotating shaft sleeve 442 penetrates and is fixed to the second hole 241. The rotating shaft 444 is disposed in the fourth hole 11. When external force is applied to rotate the USB connector 100, the rotating shaft sleeve 442 can rotate relative to the rotating shaft 444. Therefore, the USB connector 100 can rotate relative to the main body 200.

The cross section of the fifth hole 11 on the other side of the notch 10 may be circular or square. Of course, no such limitation is defined in the embodiments of the present invention.

The rotating shaft assembly 44 may be metal. The rotating shaft 444 and the rotating shaft sleeve 442 of the rotating shaft assembly may be metal. For details about the rotating shaft assembly 44, see the related part in Embodiment 1. The rotating shaft assembly 44 is not described herein in detail again.

Figure 12:
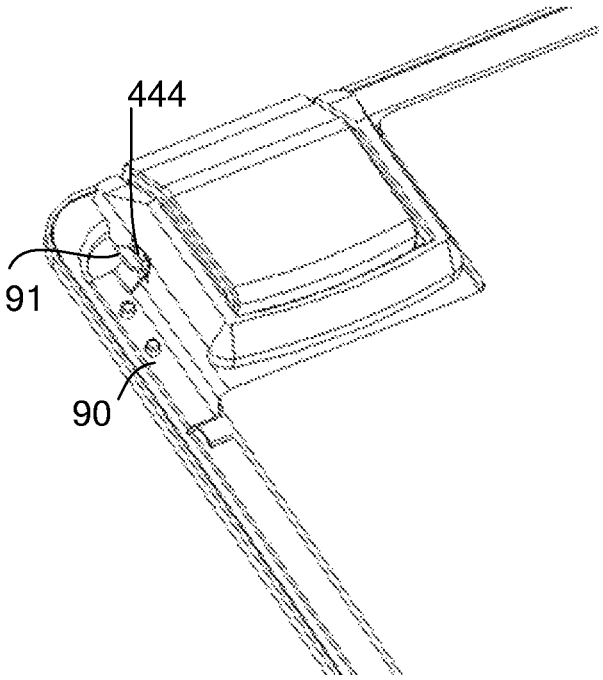
FIG. 12 is a schematic diagram of the grounding of a wireless modem according to an embodiment of the present invention.

See FIG. 9 again. The wireless modem 600 further includes a metal plate 90. A metal elastic flake 91 is formed on one end of the metal plate 90. The metal plate 90 is fixed onto the PCB 82. The metal elastic flake 91 of the metal plate 90 is connected to the rotating shaft 444. The rotating shaft 444 and the rotating shaft sleeve are metal (for example, iron or copper). In this way, the USB connector is grounded, as shown in FIG. 12.

Furthermore, the parts of the upper shell 86 and the lower shell 88 that cover the PCB 82 may be metal.

Opposite to the USB connector 100, the other side of the PCB 82 is disposed with an antenna 75. The antenna 75 is connected to a feed point of the PCB 82. The parts of the upper shell 86 and the lower shell that cover the antenna 75 may be plastic. In this way, the performance of the antenna 75 is not affected. The metal part and the plastic part of the upper shell 86 may be integrated through insert molding. Similarly, the metal part and the plastic part of the lower shell 88 may be integrated through insert molding. The antenna 75 may be an FPC antenna.

The foregoing description shows that components are disposed on one side of the PCB 82; the surface shell 84 is disposed on the side of the PCB disposed with the components. The upper shell 86 and the lower shell 88 may be welded by using ultrasonic waves. The upper shell 86 and the lower shell 88 cover the surface shell 84 and the PCB 82. In this way, the main body 200 can be very thin, as shown in FIG. 8. The wireless modem 600 can be a card-type wireless modem, which is portable and can be carried in a wallet.

See FIG. 8 again. A holder 93 is disposed on the surface of the main body 200. The holder 93 can be configured to hold the USB connector 100.

Figure 10:
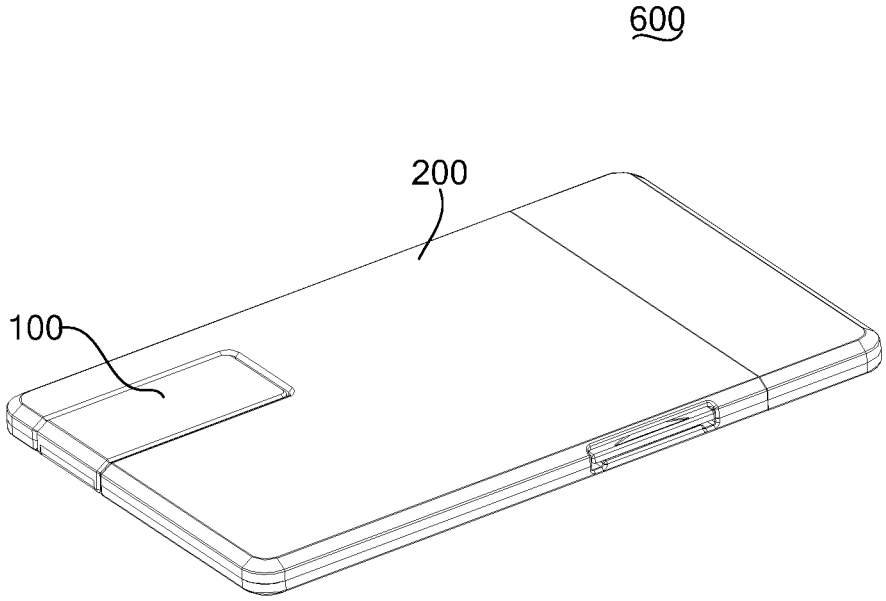
FIG. 10 is a schematic diagram of one side of a wireless modem according to an embodiment of the present invention.
Figure 11:
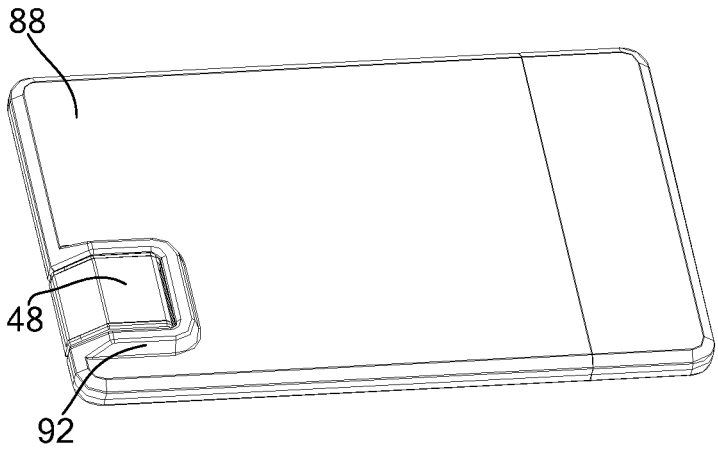
FIG. 11 is a schematic diagram of another side of a wireless modem according to an embodiment of the present invention.

FIG. 10 is a side view of the wireless modem according to this embodiment of the present invention. FIG. 11 is another side view of the wireless modem according to this embodiment of the present invention. A bump 92 is disposed around the notch 88. When the USB connector 100 is held within the holder 93, the cover 48 of the USB connector 100 is aligned to the bump 92. This makes the wireless modem elegant.

It should be noted that the descriptions in Embodiment 1 and Embodiment 2 can be applied in Embodiment 3. The description in Embodiment 2 can be applied in Embodiment 1. The terms such as "first", "second", "third", and "fourth" are provided for purpose of distinguishing the components, and do not limit the embodiments of the present invention.

The foregoing is provided for purposes of explaining and disclosing exemplary embodiments of the present invention. Modifications and adaptations to the described embodiments may be made without departing from the scope or spirit of the invention.

What is claimed is:

1. A Universal Serial Bus (USB) connector, comprising:

a USB housing comprising a bottom;

a first fixing plate and a second fixing plate respectively disposed on two opposite sides of the bottom, the second fixing plate being disposed with a second hole;

a subcard disposed on the same side of the bottom as the first fixing plate and the second fixing plate;

a metal terminal partially or fully disposed on a surface of the subcard;

a cable, wherein one end of the cable is connected to the metal terminal; and a rotating shaft assembly that penetrates the second hole, wherein the rotating shaft assembly comprises a rotating shaft sleeve and a rotating shaft, and the rotating shaft is partially disposed in the rotating shaft sleeve and can rotate relative to the rotating shaft sleeve.

2. The USB connector according to claim 1, wherein the rotating shaft assembly penetrates the second hole so that the rotating shaft sleeve penetrates and is fixed to the second hole, or the rotating shaft penetrates and is fixed to the second hole.

3. The USB connector according to claim 1, wherein the first fixing plate is disposed with a first hole, and wherein a second end of the cable penetrates the first hole.

4. The USB connector according to claim 1, further comprising a rotating shaft support disposed between the first fixing plate and the second fixing plate and disposed with a third hole on one side.

5. The USB connector according to claim 4, wherein the rotating shaft support is fixed onto the bottom of the USB housing and the second hole is opposite to the third hole.

6. The USB connector according to claim 4, wherein the rotating shaft assembly penetrates the second hole, wherein the rotating shaft sleeve penetrates the second hole and the third hole, and is fixed in the third hole.

7. The USB connector according to claim 3, wherein the first fixing plate is opposite to the second fixing plate.

8. The USB connector according to claim 4, further comprising a fixing block fixed in a space formed by the first fixing plate, the second fixing plate, and the rotating shaft support.

9. The USB connector according to claim 4, wherein the subcard extends toward a space formed by the rotating shaft support and the first fixing plate along the plane where the subcard is disposed to form an extension, wherein two bumps are disposed on the extension.

10. The USB connector according to claim 1, further comprising a cover, wherein the cover forms an enclosed space with the first fixing plate and the second fixing plate.

11. The USB connector according to claim 1, further comprising a fixing bracket fixed at a joint between the one end of the cable and the metal terminal.

12. The USB connector according to claim 1, further comprising convex lines respectively disposed on the bottom of the housing along two sides of the subcard, wherein the first fixing plate, the second fixing plate, the subcard, and the convex lines are on a same end of the bottom.

13. The USB connector according to claim 12, further comprising a misplug prevention structure disposed on one end of each convex line.

14. A wireless modem, comprising:

a main body; and a Universal Serial Bus (USB) connector, wherein the USB connector comprises a USB housing, a subcard, a cable, a metal terminal, and a rotating shaft assembly, wherein the USB housing comprises a bottom with a first fixing plate and a second fixing plate on two opposite sides of the bottom, wherein the second fixing plate is disposed with a second hole, wherein the subcard is disposed on the bottom, wherein the subcard, the first fixing plate, and the second fixing plate are on a same side of the bottom, wherein the metal terminal is partially or fully disposed on a surface of the subcard, wherein one end of the cable is connected to the metal terminal, and the other end of the cable is connected to a Printed Circuit Board (PCB) of the main body, and wherein the USB connector connects to the main body through the rotating shaft assembly.

15. The wireless modem according to claim 14, wherein the first fixing plate is disposed with a first hole, and a second end of the cable is connected to the PCB of the main body, wherein the other end of the cable penetrates the first hole and is connected to the PCB of the main body.

16. The wireless modem according to claim 14, wherein the main body comprises a surface shell, the PCB, an upper shell, and a lower shell, wherein components are disposed on one side of the PCB, wherein the surface shell is disposed on the side of the PCB disposed with the components, wherein the upper shell is disposed on one side of the surface shell, wherein the lower shell is disposed on a side opposite to the side of the PCB disposed with the components, wherein the upper shell and the lower shell are fixed, and wherein the surface shell and the PCB are disposed in a space formed by the upper shell and the lower shell.

17. The wireless modem according to claim 15, wherein the main body comprises a surface shell, the PCB, an upper shell, and a lower shell, wherein components are disposed on one side of the PCB, wherein the surface shell is disposed on the side of the PCB disposed with the components, the upper shell is disposed on one side of the surface shell, wherein the lower shell is disposed on a side opposite to the side of the PCB disposed with the components, wherein the upper shell and the lower shell are fixed, and wherein the surface shell and the PCB are disposed in a space formed by the upper shell and the lower shell.

18. The wireless modem according to claim 16, wherein a notch is disposed on one side of the surface shell, and a fourth hole and a fifth hole are respectively disposed on two sides of the notch.

19. The wireless modem according to claim 18, wherein the rotating shaft assembly comprises a rotating shaft sleeve and a rotating shaft, and the rotating shaft is partially disposed into and can rotate relative to the rotating shaft sleeve, the USB connector being connected to the main body through the rotating shaft assembly, wherein:

the rotating shaft is fixed to the fourth hole, and the rotating shaft sleeve penetrates and is fixed to the second hole; or the rotating shaft sleeve is fixed to the fourth hole, and the rotating shaft penetrates and is fixed to the second hole.

20. The wireless modem according to claim 18, wherein the USB connector further comprises a rotating shaft support is disposed between the first fixing plate and the second fixing plate and is disposed with a third hole on one side.

21. The wireless modem according to claim 20, wherein the rotating shaft assembly comprises a rotating shaft sleeve and a rotating shaft, and the rotating shaft is partially disposed into and can rotate relative to the rotating shaft sleeve, the USB connector being connected to the main body through the rotating shaft assembly, wherein:

the rotating shaft is fixed to the fourth hole, and the rotating shaft sleeve penetrates the second hole and the third hole and is fixed to the third hole; or the rotating shaft sleeve is fixed to the fourth hole, and the rotating shaft penetrates the second hole and the third hole and is fixed to the third hole; or the rotating shaft penetrates and protrudes beyond the second hole, a protruding part of the rotating shaft outside the second hole is fixed to the fourth hole, and the rotating shaft sleeve penetrates and is fixed to the third hole; or the rotating shaft sleeve penetrates and protrudes the second hole, a protruding part of the rotating shaft sleeve outside the second hole is fixed to the fourth hole, and the rotating shaft penetrates and is fixed to the third hole.

22. The wireless modem according to claim 21, further comprising a circular shaft disposed on one side of the first fixing plate around a first hole and disposed in the fifth hole, the first hole disposed in the first fixing plate.

23. The wireless modem according to claim 14, wherein the rotating shaft assembly comprises a rotating shaft sleeve and a rotating shaft, the rotating shaft is partially disposed in and can rotate relative to the rotating shaft sleeve, wherein the rotating shaft and the rotating shaft sleeve are metal;

the wireless modem further comprising a metal plate and a metal elastic flake disposed one end of the metal plate, wherein the metal elastic flake is fixed to the PCB and connected to the rotating shaft.

24. The wireless modem according to claim 14, wherein the wireless modem is a card-type wireless modem.

25. The wireless modem according to claim 14, further comprising an antenna located adjacent a side of the PCB opposite to the USB connector.

26. A Universal Serial Bus (USB) connector, comprising:

a USB housing comprising a bottom with a first fixing plate and a second fixing plate respectively disposed on two opposite sides of the bottom, the first fixing plate is disposed with a first hole, and the second fixing plate is disposed with a second hole;

a subcard disposed on a same side of the bottom with the first fixing plate and the second fixing plate;

a metal terminal partially or fully disposed on a surface of the subcard;

a cable, wherein one end of the cable is connected to the metal terminal and the other end through the first hole;

a rotating shaft support, wherein the rotating shaft support is disposed with a third hole on one side, located between the first fixing plate and the second fixing plate, and fixed on one side of the second fixing plate, and the second hole communicates with the third hole; and a rotating shaft assembly, wherein the rotating shaft assembly comprises a rotating shaft and a rotating shaft sleeve, the rotating shaft is partially disposed in and can rotate relative to the rotating shaft sleeve and protrudes beyond the second hole, and the rotating shaft sleeve penetrates the third hole through the second hole and fixed to the third hole.

27. The USB connector according to claim 4, wherein the rotating shaft support is fixed on one side of the second fixing plate and the second hole communicates with the third hole.

28. The USB connector according to claim 4, wherein the rotating shaft assembly penetrates the second hole, wherein the rotating shaft penetrates the second hole and the third hole, and is fixed in the third hole.

29. The USB connector according to claim 4, wherein the rotating shaft assembly penetrates the second hole, wherein the rotating shaft penetrates and protrudes beyond the second hole, and the rotating shaft sleeve penetrates and is fixed in the third hole.

30. The USB connector according to claim 4, wherein the rotating shaft assembly penetrates the second hole, wherein the rotating shaft sleeve penetrates and protrudes the second hole, and the rotating shaft penetrates and is fixed in the third hole.

* * * * *